US006890415B2

(12) United States Patent
Woodruff et al.

(10) Patent No.: US 6,890,415 B2
(45) Date of Patent: May 10, 2005

(54) REACTOR VESSEL HAVING IMPROVED CUP, ANODE AND CONDUCTOR ASSEMBLY

(75) Inventors: Daniel J. Woodruff, Kalispell, MT (US); Kyle M. Hanson, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 190 days.

(21) Appl. No.: 10/167,763

(22) Filed: Jun. 11, 2002

(65) Prior Publication Data

US 2003/0047448 A1 Mar. 13, 2003

Related U.S. Application Data

(60) Continuation of application No. 09/811,379, filed on Mar. 15, 2001, now Pat. No. 6,428,660, which is a division of application No. 09/112,300, filed on Jul. 9, 1998, now Pat. No. 6,228,232.

(51) Int. Cl.[7] ..... C25D 5/20; C25D 17/00

(52) U.S. Cl. ..... 205/148; 204/224 R; 204/275.1; 204/297.01

(58) Field of Search ..... 205/148; 204/224 R, 204/275.1, 297.01, 224 M

(56) References Cited

U.S. PATENT DOCUMENTS

| | | |
|---|---|---|
| 3,798,003 A | 3/1974 | Ensley et al. |
| 4,113,577 A | 9/1978 | Ross et al. |

(Continued)

FOREIGN PATENT DOCUMENTS

| | | |
|---|---|---|
| DE | 4411427 | 11/1992 |
| JP | 9-2628886 | 4/1997 |

(Continued)

OTHER PUBLICATIONS

*Buehler Simplemet 2000–FN00682 and FN00935, no date.

*Parker (Editor), "McGraw–Hill Dictionary of Scientific and Technical Terms, Fifth Edition," McGraw–Hill, Inc., 1994, definition of "bayonet coupling", no month.

*Primary Examiner*—Donald R. Valentine
(74) *Attorney, Agent, or Firm*—Perkins Coie LLP

(57) ABSTRACT

An improved anode, cup and conductor assembly for a reactor vessel includes an anode assembly supported within a cup which holds a supply of process fluid. The cup is supported around its perimeter within the reactor vessel. The anode assembly has an anode shield carrying an anode, the anode shield having upwardly extending brackets with radially extending members. A diffusion plate is supported above the anode by the anode brackets using first bayonet connections. The anode shield and the anode are supported from below by a delivery tube which also serves to deliver process fluid to the cup. A second bayonet connection is provided between a top portion of the delivery tube and the anode assembly. The fluid delivery tube has a fixed height within the vessel. The anode elevation is adjusted by the interposing of a spacer of desired thickness between the anode and the tube. An electrical conductor is connected to the anode, and passes through the tube to be electrically accessible outside the vessel. The conductor is connected to the anode with a plug-in connection which is completed when the tube is coupled to the anode by the second bayonet connection. A spring loaded bellows seal and a corrugated sleeve seal the electrical conductor from the anode, through the delivery tube, and to the outside electrical accessibility. The diffusion plate and the anode assembly are installable and removable from a top side of the reactor vessel using a tool which is lockable to the diffusion plate or to the anode. The tool provides a handle for manual engagement or disengagement of the first and second bayonet connections.

24 Claims, 13 Drawing Sheets

U.S. PATENT DOCUMENTS

| | | | | |
|---|---|---|---|---|
| 4,165,252 | A | | 8/1979 | Gibbs |
| 4,222,834 | A | | 9/1980 | Bacon et al. |
| 4,304,641 | A | | 12/1981 | Grandia et al. |
| 4,360,410 | A | * | 11/1982 | Fletcher et al. ..... 205/148 |
| 4,466,864 | A | | 8/1984 | Bacon et al. |
| 4,469,566 | A | | 9/1984 | Wray |
| 4,585,539 | A | | 4/1986 | Edson |
| 4,696,729 | A | | 9/1987 | Santini |
| 4,715,934 | A | * | 12/1987 | Tamminen ..... 205/74 |
| 4,741,624 | A | | 5/1988 | Barroyer |
| 4,868,992 | A | | 9/1989 | Crafts et al. |
| 5,024,746 | A | | 6/1991 | Stierman et al. |
| 5,169,408 | A | | 12/1992 | Biggerstaff et al. |
| 5,227,041 | A | | 7/1993 | Brogden et al. |
| 5,271,972 | A | | 12/1993 | Kwok et al. |
| 5,332,271 | A | | 7/1994 | Grant et al. |
| 5,340,456 | A | | 8/1994 | Mehler |
| 5,391,285 | A | | 2/1995 | Lytle et al. |
| 5,405,518 | A | | 4/1995 | Hsieh et al. |
| 5,427,674 | A | | 6/1995 | Langenskiold et al. |
| 5,441,629 | A | | 8/1995 | Kosaki |
| 5,447,615 | A | | 9/1995 | Ishida |
| 5,514,258 | A | | 5/1996 | Brinket et al. |
| 5,683,564 | A | | 11/1997 | Reynolds |
| 5,684,654 | A | | 11/1997 | Searle et al. |
| 5,731,678 | A | | 3/1998 | Zila et al. |
| 5,755,948 | A | | 5/1998 | Lazaro et al. |
| 5,829,791 | A | | 11/1998 | Kotsubo et al. |
| 5,932,077 | A | | 8/1999 | Reynolds |
| 5,980,706 | A | | 11/1999 | Bleck et al. |
| 5,985,126 | A | | 11/1999 | Bleck et al. |
| 6,001,235 | A | | 12/1999 | Arken et al. |
| 6,027,631 | A | | 2/2000 | Broadbent |
| 6,080,288 | A | | 6/2000 | Schwartz et al. |
| 6,099,702 | A | | 8/2000 | Reid et al. |
| 6,103,085 | A | | 8/2000 | Woo et al. |
| 6,159,354 | A | | 12/2000 | Contolini et al. |
| 6,193,859 | B1 | | 2/2001 | Contolini et al. |
| 6,228,232 | B1 | | 5/2001 | Woodruff et al. |
| 6,254,742 | B1 | | 7/2001 | Hanson et al. |
| 6,280,582 | B1 | | 8/2001 | Woodruff et al. |
| 6,280,583 | B1 | | 8/2001 | Woodruff et al. |
| 6,409,892 | B1 | | 6/2002 | Woodruff et al. |
| 6,428,660 | B2 | | 8/2002 | Woodruff et al. |
| 6,428,662 | B1 | | 8/2002 | Woodruff et al. |

FOREIGN PATENT DOCUMENTS

| | | |
|---|---|---|
| JP | 2002-520489 | 7/2002 |
| TW | 573070 | 1/2004 |
| WO | WO 00/03072 | 1/2000 |
| WO | WO 00/40779 | 7/2000 |

* cited by examiner

REACTOR VESSEL HAVING IMPROVED CUP, ANODE AND CONDUCTOR ASSEMBLY

CROSS-REFERENCE TO RELATED APPLICATIONS

This application is a continuation of U.S. patent application Ser. No. 09/811,379, filed March 15, 2001, now U.S. Pat. No. 6,428,660 which is a divisional of U.S. patent application Ser. No. 09/112,300, filed July 9, 1998 now U.S. Pat. No. 6,228,232.

STATEMENT REGARDING FEDERALLY SPONSORED RESEARCH OR DEVELOPMENT

Not applicable

BACKGROUND OF THE INVENTION

In the production of semiconductor integrated circuits and other semiconductor articles from semiconductor wafers, it is often necessary to provide multiple metal layers on the wafer to serve as interconnect metallization which electrically connects the various devices on the integrated circuit to one another. Traditionally, aluminum has been used for such interconnects, however, it is now recognized that copper metallization may be preferable.

The semiconductor manufacturing industry has applied copper onto semiconductor wafers by using a "damascene" electroplating process where holes, commonly called "vias", trenches and/or other recesses are formed onto a substrate and filled with copper. In the damascene process, the wafer is first provided with a metallic seed layer which is used to conduct electrical current during a subsequent metal electroplating step. The seed layer is a very thin layer of metal which can be applied using one or more of several processes. For example, the seed layer of metal can be laid down using physical vapor deposition or chemical vapor deposition processes to produce a layer on the order of 1,000 angstroms thick. The seed layer can advantageously be formed of copper, gold, nickel, palladium, or other metals. The seed layer is formed over a surface which is convoluted by the presence of the vias, trenches, or other recessed device features.

A copper layer is then electroplated onto the seed layer in the form of a blanket layer. The blanket layer is plated to an extent which forms an overlying layer, with the goal of providing a copper layer that fills the trenches and vias and extends a certain amount above these features. Such a blanket layer will typically be formed in thicknesses on the order of 10,000 to 15,000 angstroms (1–1.5 microns).

After the blanket layer has been electroplated onto the semiconductor wafer, excess metal material present outside of the vias, trenches, or other recesses is removed. The metal is removed to provide a resulting pattern of metal layer in the semiconductor integrated circuit being formed. The excess plated material can be removed, for example, using chemical mechanical planarization. Chemical mechanical planarization is a processing step which uses the combined action of a chemical removal agent and an abrasive which grinds and polishes the exposed metal surface to remove undesired parts of the metal layer applied in the electroplating step.

The electroplating of the semiconductor wafers takes place in a reactor assembly. In such an assembly an anode electrode is disposed in a plating bath, and the wafer with the seed layer thereon is used as a cathode. Only a lower face of the wafer contacts the surface of the plating bath. The wafer is held by a support system that also conducts the requisite cathode current to the wafer. The support system may comprise conductive fingers that secure the wafer in place and also contact the wafer in order to conduct electrical current for the plating operation.

One embodiment of a reactor assembly is disclosed in U.S. Ser. No. 08/988,333 filed Sep. 30, 1997 entitled "Semiconductor Plating System Workpiece Support Having Workpiece—Engaging Electrodes With Distal Contact Part and Dielectric Cover." FIG. 1 illustrates such an assembly. As illustrated the assembly 10 includes reactor vessel 11 for electroplating a metal, a processing head 12 and an electroplating bowl assembly 14.

As shown in FIG. 1, the electroplating bowl assembly 14 includes a cup assembly 16 which is disposed within a reservoir chamber 18. Cup assembly 16 includes a fluid cup 20 holding the processing fluid for the electroplating process. The cup assembly of the illustrated embodiment also has a depending skirt 26 which extends below a cup bottom 30 and may have flutes open therethrough for fluid communication and release of any gas that might collect as the reservoir chamber fills with liquid. The cup can be made from polypropylene or other suitable material.

A bottom opening in the bottom wall 30 of the cup assembly 16 receives a polypropylene riser tube 34 which is adjustable in height relative thereto by a threaded connection between the bottom wall 30 and the tube 34. A fluid delivery tube 44 is disposed within the riser tube 34. A first end of the delivery tube 44 is secured by a threaded connection 45 to an anode 42. An anode shield 40 is attached to the anode 42 by screws 74. The delivery tube 44 supports the anode within the cup. The fluid delivery tube 44 is secured to the riser tube 34 by a fitting 50. The fitting 50 can accommodate height adjustment of the delivery tube 44 within the riser tube. As such, the connection between the fitting 50 and the riser tube 34 facilitates vertical adjustment of the delivery tube and thus the anode vertical position. The delivery tube 44 can be made from a conductive material, such as titanium, and is used to conduct electrical current to the anode 42 as well as to supply fluid to the cup.

Process fluid is provided to the cup through the delivery tube 44 and proceeds therefrom through fluid outlet openings 56. Plating fluid fills the cup through the openings 56, supplied from a plating fluid pump (not shown).

An upper edge of the cup side wall 60 forms a weir which limits the level of electroplating solution or process fluid within the cup. This level is chosen so that only the bottom surface of the wafer W is contacted by the electroplating solution. Excess solution pours over this top edge into the reservoir chamber 18. The level of fluid in the chamber 18 can be maintained within a desired range for stability of operation by monitoring and controlling the fluid level with sensors and actuators. One configuration includes sensing a high level condition using an appropriate switch 63 and then draining fluid through a drain line controlled by a control valve (not shown). The out flow liquid from chamber 18 can be returned to a suitable reservoir. The liquid can then be treated with additional plating chemicals or other constituents of the plating or other process liquid, and used again.

A diffusion plate 66 is provided above the anode 42 for providing a more controlled distribution of the fluid plating bath across the surface of wafer W. Fluid passages in the form of perforations are provided over all, or a portion of, the diffusion plate 66 to allow fluid communication therethrough. The height of the diffusion plate within the cup assembly is adjustable using threaded diffusion plate height adjustment mechanisms 70.

The anode shield 40 is secured to the underside of the consumable anode 42 using anode shield fasteners 74. The anode shield prevents direct impingement on the anode by the plating solution as the solution passes into the processing chamber. The anode shield 40 and anode shield fasteners 74 can be made from a dielectric material, such as polyvinylidene fluoride or polypropylene. The anode shield serves to electrically isolate and physically protect the backside or the anode. It also reduces the consumption of organic plating liquid additives.

The processing head 12 holds a wafer W for rotation about a vertical axis R within the processing chamber. The processing head 12 includes a rotor assembly having a plurality of wafer-engaging fingers 89 that hold the wafer against holding features of the rotor. Fingers 89 are preferably adapted to conduct current between the wafer and a plating electrical power supply and act as current thieves. Portions of the processing head 12 mate with the processing bowl assembly 14 to provide a substantially closed processing volume 13.

The processing head 12 can be supported by a head operator. The head operator can include an upper portion which is adjustable in elevation to allow height adjustment of the processing head. The head operator also can have a head connection shaft which is operable to pivot the head 12 about a horizontal pivot axis. Pivotal action of the processing head using the operator allows the processing head to be placed in an open or faced-up position (not shown) for loading and unloading wafer W.

Processing exhaust gas must be removed from the volume 13. FIGS. 1 and 2 illustrate an outer vessel side wall 76 that extends upwardly from the vessel base plate 75 to a top end into which is nested an intermediate exhaust ring 77 having circumferentially spaced-apart slots 78 therethrough. The slots 78 communicate exhaust gas from inside the vessel 13 to a thin annular plenum 79 located between the intermediate exhaust ring 77 and the outer bowl side wall 76. Surrounding the outer bowl side wall 76 is a vessel ring assembly 80 which forms with the side wall 76 an external, annular collection chamber 81. Gas which is collected in the plenum 79 passes through intermittent orifices 82 and into the annular collection chamber 81. Gas collected in the collection chamber 81 is passed through an exhaust nozzle 83 to be collected and recycled.

The above described apparatus can suffer from some drawbacks. The threaded connection 45 of the anode and the delivery tube may introduce some risk of thread damage during maintenance or installation of a new anode onto the delivery tube. This type of construction also makes the rotational engagement and installation of, or the disengagement and removal of, the anode to/from the delivery tube difficult and time consuming, due to the heavy weight of the anode and the tight clearances between the anode 42 and the cup sidewall 60. The threaded connection requires a sufficient number of anode rotations for a complete threaded engagement during assembly, or complete threaded disengagement during disassembly.

Additionally, in electroplating processes using a consumable anode, it is desired to have an anodic film deposited on a surface of the anode. This film is applied to the anode before wafer processing. However, this anodic film is very fragile and any hand or tool contact with the anodic film during engagement or disengagement is likely to damage the film, which must then be re-grown. This makes the threaded, rotational manipulation and handling of the anode during installation or removal particularly difficult. Also, handling the anode assembly or the diffusion plate during the assembly and disassembly can contaminate surfaces of the anode assembly, the diffusion plate, or other inside surfaces within the volume 13.

The threaded height adjustment of the diffusion plate using threaded height adjustment mechanisms 70 also requires a time consuming operation to precisely install the diffusion plate to the anode. A plurality of securements, such as Allen head screws, are required to be removed to disassemble the diffusion plate from the anode and reinstalled during reassembly. This is an important consideration since the diffusion plate must be removed routinely to inspect anodic film formation on the anode. The adjustment of the plural screw mechanisms can also introduce height and level inaccuracies of the diffusion plate with respect to the anode and/or reactor cup.

Also, the cup assembly located inside the reactor vessel is supported by an adjustable threaded engagement with the riser tube. The threaded engagement may introduce cup height and level misadjustments.

The threaded height adjustment of the anode assembly within the cup, by adjusting the delivery tube, can introduce height and levelness misadjustments. Additionally, the delivery tube being vertically adjustable by loosening of a locking nut located below the reactor vessel, requires access to both the top side of the cup for viewing the anode height adjustment, and the bottom side of the vessel to loosen this locking nut. If the reactor vessel is supported on a deck this requires access to both above and below the deck. Additionally, the delivery tube being vertically adjustable at the reactor vessel base plate requires a more complex seal mechanism between the delivery tube and the anode post at the vessel base plate. Also, the delivery tube serving the dual function of being a liquid conduit and an electrical conductor requires the tube to be constructed of a metallic material which is conductive yet substantially inert to the process chemistry. Such a conduit has been composed of titanium, which is costly.

The present inventors have recognized that it would be advantageous to provide a reactor vessel having an improved connection arrangement between anode and diffusion plate, and between anode and anode support structure to avoid some of the foregoing problems. Further, the inventors have recognized that it would be advantageous to provide a reactor vessel arrangement that facilitates easier assembly and disassembly of diffusion plate, anode, anode support structure and anode electrical conductor than found in the foregoing system. Still further, the present inventors have recognized that it would be advantageous to provide a reactor vessel Which eliminates threaded connections to as great a degree as possible.

The inventors have recognized that it would be advantageous to provide a reactor vessel having: an improved mechanical connection arrangement between anode and delivery tube, an improved electrical connection between anode and an outside electrical power source, an improved accessibility for adjusting elements of the reactor vessel, an improved accuracy of vertical adjustment between the anode and the cup, and an improved accuracy of vertical and level adjustment of the cup within the reactor vessel.

BRIEF SUMMARY OF THE INVENTION

An improved reactor vessel is disclosed herein. The improved reactor vessel includes a reservoir container having a base with a surrounding container sidewall upstanding from the base. A cup is arranged above the base, the cup having a bottom wall and a surrounding cup sidewall upstanding from the bottom wall, the cup sidewall defining a level of process fluid held within the cup. The cup is supported within the reactor vessel on the surrounding container sidewall substantially around a perimeter of the cup. Unlike the reactor vessel of FIG. 1, which supports the cup at a central location by threaded engagement with the riser tube, the cup of the present invention is supported around its outside perimeter at a precise and stable level with respect to the reactor vessel. An electrode plate, such as a consumable anode, is arranged within the cup below the fluid level.

The reactor vessel includes bayonet style connections between an anode assembly and a diffusion plate, and a bayonet style connection between an anode support structure and the anode assembly. A tool is provided which simplifies the installation and removal of the diffusion plate and the anode assembly, while minimizing the risk of contamination or damage to the anode assembly, diffusion plate, or other surfaces within the reactor vessel.

In one embodiment, the reactor vessel includes as separate pieces, an anode electrical conductor and a fluid delivery tube. The delivery tube functions as the anode support structure for adjustably supporting the anode assembly, and as a conduit for delivering process fluid into the cup surrounding the anode. A corrugated sleeve or tube seals the electrical conductor within the delivery tube.

The fluid delivery tube is fixed at its top end to the anode assembly by a bayonet connection. A protruding tip of the conductor which extends above the delivery tube engages a socket formed in the anode. The engagement of the tip into the socket occurs simultaneously with the engagement of the bayonet connection. A spring within the bellows seal resiliently holds the bayonet connection in its engaged condition and assists in maintaining a sealed connection between the bellows seal and the anode.

The delivery tube is sealed to the base and extends through the cup bottom wall to support the anode assembly from the base. The tube has a substantially closed bottom and a top. The anode electrical conductor includes a conductor wire which is arranged within the tube and passes through the tube bottom and top, the conductor wire being connected to the protruding tip. The tube includes an inlet opening for receiving process fluid, and at least one outlet opening into the cup.

The reactor vessel includes a fixed incremental vertical adjustment and level adjustment between the anode assembly and the reactor cup. A spacer (or spacers) having a desired thickness is (are) interposed between the anode and the delivery tube to set the anode height within the cup. The spacer is C-shaped so as to be installable without complete dismantling of the electrical conductor assembly. The electrical conductor includes an excess length within the delivery tube for the purpose of allowing room for the removal and installation of the C-shaped spacer during level adjustment of the cup.

The anode assembly includes an anode shield that carries the anode. A plurality of brackets, preferably formed as a unitary structure with the anode shield, extend upwardly from the anode. The diffusion plate is connected to the plurality of brackets by a bayonet connection at each bracket. The diffusion plate is thus held elevated above the anode.

The reactor vessel configuration simplifies construction and assembly thereof. The anode assembly can easily be removed from the fluid delivery tube and the electrical conductor disconnected from the anode due to the bayonet connection between the delivery tube and the anode, and the tip/socket connection between the electrical conductor and the anode. A threaded connection between anode assembly and delivery tube is eliminated. Misadjustment of the anode assembly caused by the threaded connection between delivery tube and the anode assembly is eliminated. Assembly drawbacks associated with threaded connections such as damaged threads, and time consuming assembly/disassembly are reduced or avoided. The anode assembly need only be depressed, turned and withdrawn to be disengaged and removed from the reactor vessel.

The level adjustment of the anode can be accomplished entirely with access only on a top side of the reactor. No loosening operation or threaded adjustment on a bottom side of the reactor is required. The anode can be removed and installed from a top side of the reactor. The protruding tip and its associated flange can then be lifted up so that the spacer can be exchanged with a replacement spacer or spacers, for a more precise height or level adjustment.

By replacing the delivery tube having a threaded vertical adjustment at the vessel bottom wall with a fixed delivery tube having no relative movement between the vessel bottom wall and the tube, a reduced seal mechanism complexity is achieved for the delivery tube at the vessel bottom wall. The delivery tube can be permanently sealed to the vessel bottom wall without provision for relative vertical adjustment between the delivery tube and an anode post at the bottom wall.

A conductor wire sealed from the process fluid by a dielectric sleeve is used in combination with a dielectric material delivery tube resulting in an effective and more cost efficient construction. By separating the process fluid delivery function from the electrical conduction function, the need for a costly titanium delivery tube is eliminated.

The diffusion plate is more easily removed and reinstalled by virtue of the bayonet connections at each of the brackets of the anode shield. The small screws which were previously required to be removed with, for example, an Allen wrench, to remove the diffusion plate from the diffusion plate height adjusting mechanism, are eliminated. Additionally, the threaded height adjustment mechanisms are eliminated which could otherwise adversely vary the installed height or levelness of the diffusion plate.

A multi-function tool is also provided which functions to engage and install/remove the diffusion plate from the anode assembly, and also to engage and install/remove the anode assembly from the fluid delivery tube. The tool reduces or eliminates handling of the diffusion plate and the anode assembly during installation or removal which can cause anodic film damage, contamination and damage to the diffusion plate or anode assembly or the vessel interior.

An additional advantage of the bayonet connections of the diffusion plate and the anode in combination with the multi-function tool is the fact that a reduced overhead clearance is required to remove the diffusion plate and the anode. In comparison, to manually detach and remove, and later reinstall, the diffusion plate and anode of the reactor shown in FIG. 1, the entire head assembly including the lift and rotate mechanism which manipulates the rotor must be removed. After the reactor is reassembled and the head assembly is reinstalled, the wafer loading robot or manipulator (not shown) which loads wafers onto the rotor, must be reinstructed or recalibrated to ensure an accurate placement of wafers on the rotor. This step is time consuming and costly. Because the diffusion plate and anode assembly of the present invention can be manipulated and removed using simplified hand manipulations with the multi-function tool, it is possible that the lift and rotate mechanism can remain in place and only the rotor removed from the processing head to obtain enough access for diffusion plate and anode assembly removal and reinstallation. It is anticipated that this advantage of the invention will result in a reduced disassembly, inspection, and reassembly time during maintenance of the reactor vessel.

Numerous other advantages and features of the present invention will become readily apparent from the following detailed description of the invention and the embodiments thereof, from the claims and from the accompanying drawings in which details of the invention are fully and completely disclosed as part of this specification.

DETAILED DESCRIPTION OF THE INVENTION

Figure 1:
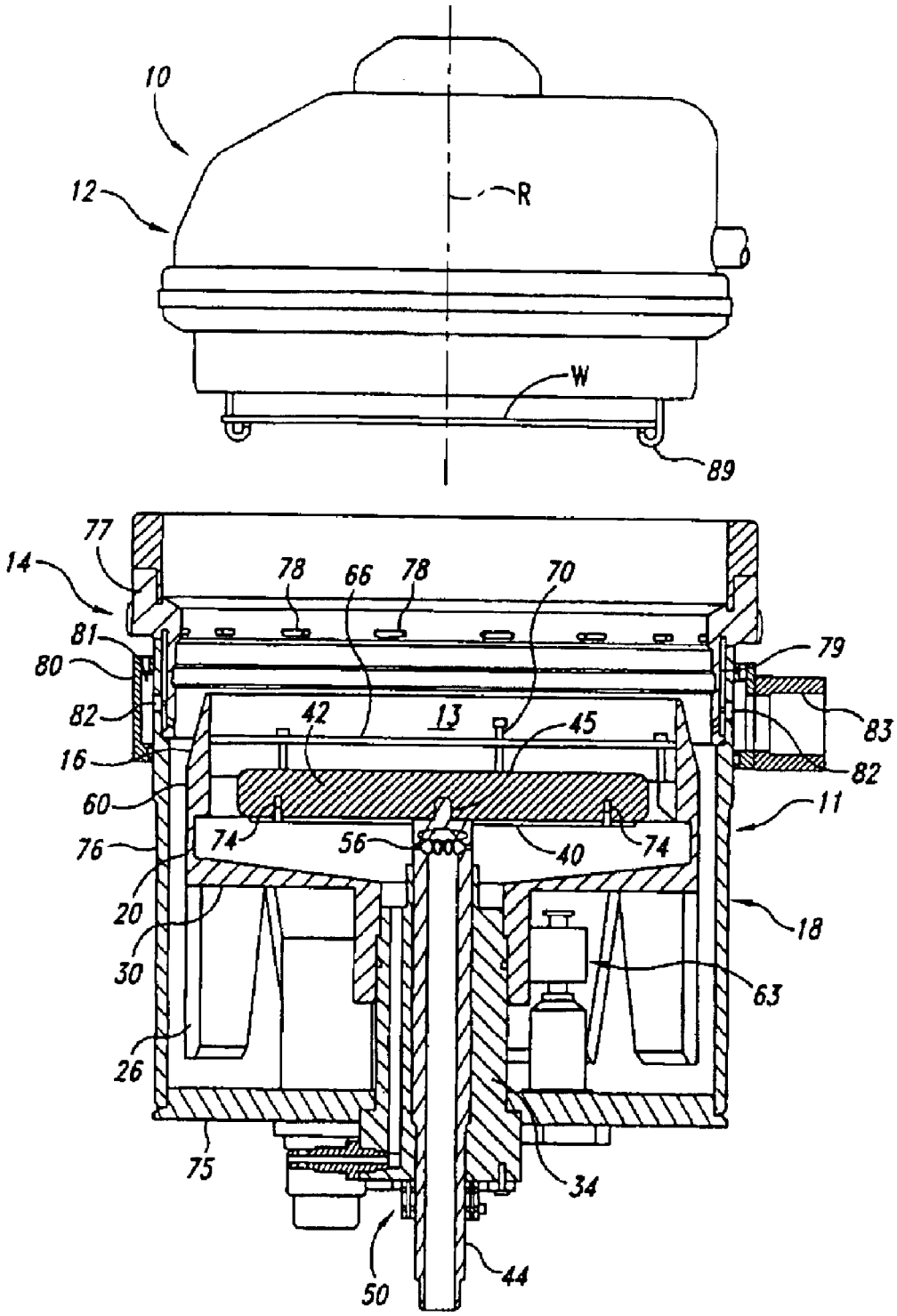
FIG. 1 is an exploded partially sectional view of a reactor vessel and processing head.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Figure 2:
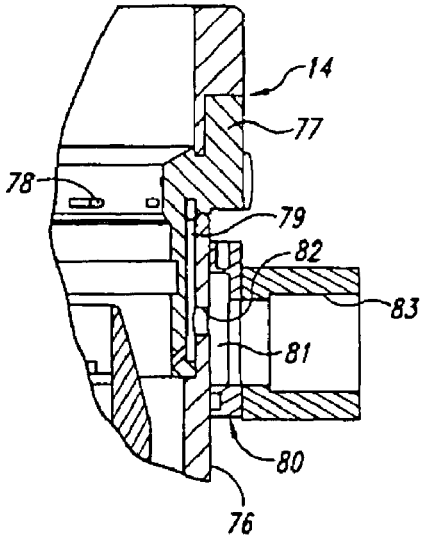
FIG. 2 is an enlarged fragmentary sectional view taken from FIG. 1.
Figure 3:
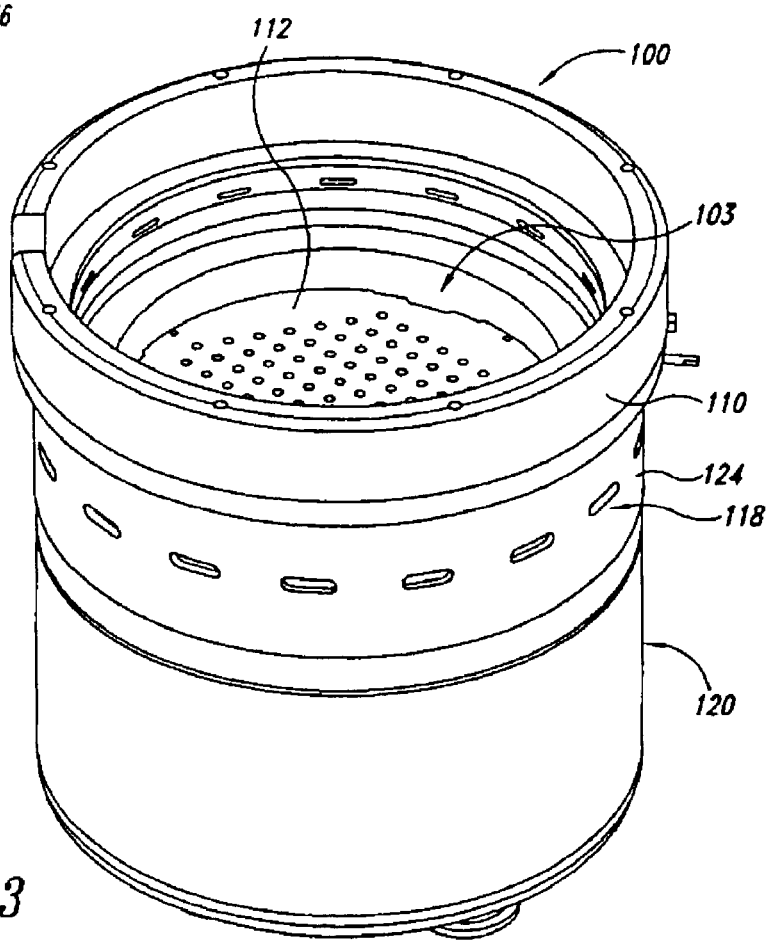
FIG. 3 is a perspective view of a reactor vessel constructed in accordance with one embodiment of the present invention.

FIGS. 3–6 illustrate a reactor vessel 100 which is to be used in cooperation with a processing head 12 (as shown in FIG. 1). The processing head 12 may, for example, be of the type disclosed in U.S. Ser. No. 08/988,333 filed Sep. 30, 1997 entitled: "Semiconductor Plating System Workpiece Support Having Workpiece—Engaging Electrodes With Distal Contact Part and Dielectric Cover" herein incorporated by reference. The processing head holds a wafer to be processed within a substantially closed processing volume 103 of the reactor vessel 100, and rotates the wafer during processing. The vessel 100 is shown without a vessel exhaust ring assembly for clarity to illustrate the underlying parts. It is to be understood that the outer vessel exhaust ring assembly 80 and exhaust nozzle 83 as shown for example in FIG. 1 would be mounted around the vessel 100 as shown for example in FIG. 2.

The reactor vessel 100 includes a rotor supporting ring or rim 110 mounted on an inner exhaust ring 124 which is carried on a reservoir container 120. A diffusion plate 112 is carried by an anode shield 116 which, in turn, carries an anode 114. The anode 114 is preferably a consumable anode composed of copper or other plating material. The anode 114 and the anode shield 116 are fastened together forming an anode assembly 117. A reactor cup assembly 118 is supported on, and partially held within, a reservoir container assembly 120. An anode electrical conductor assembly 122 extends vertically through the reservoir container 120 and makes electrical connection with the anode 114 as described below. A de-plating electrode 123 in the form of a ring 123*a* and a contact support 123*b* allows for periodic de-plating of wafer-engaging fingers 89 (shown in FIG. 1).

Figures 7, 7A:
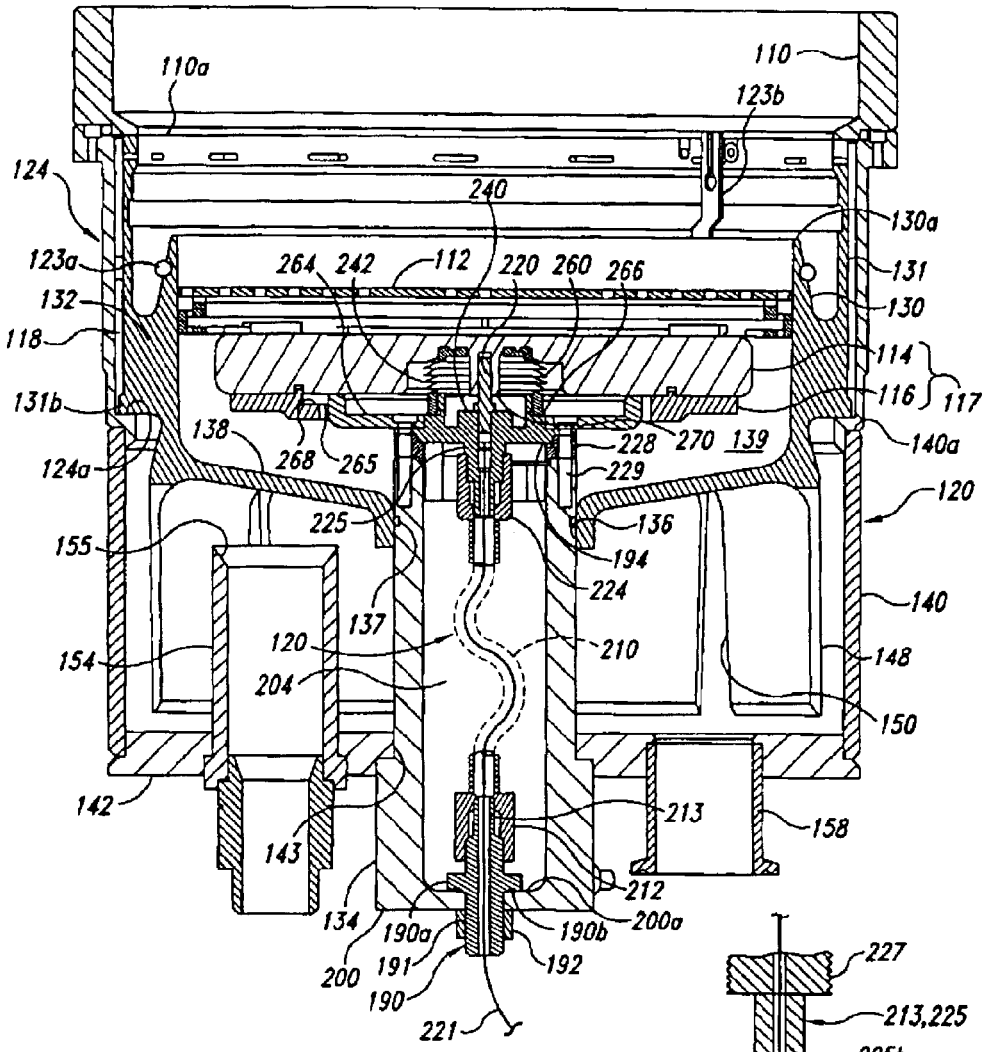
FIG. 7 is a sectional view taken generally along line 7—7 of FIG. 5.
FIG. 7A is an enlarged fragmentary sectional view from FIG. 7.
Figure 8:
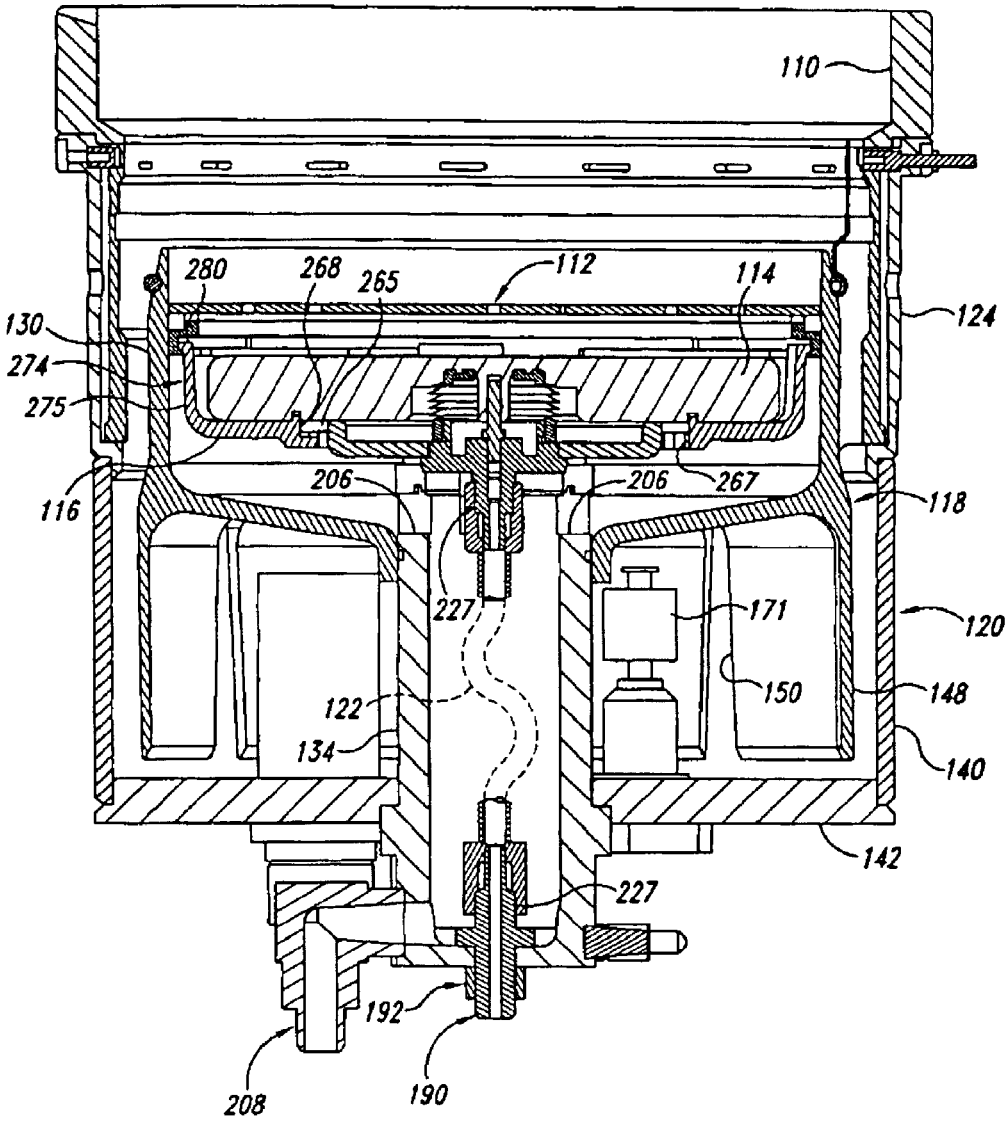
FIG. 8 is a sectional view taken generally along line 8—8 of FIG. 5.
Figure 9:
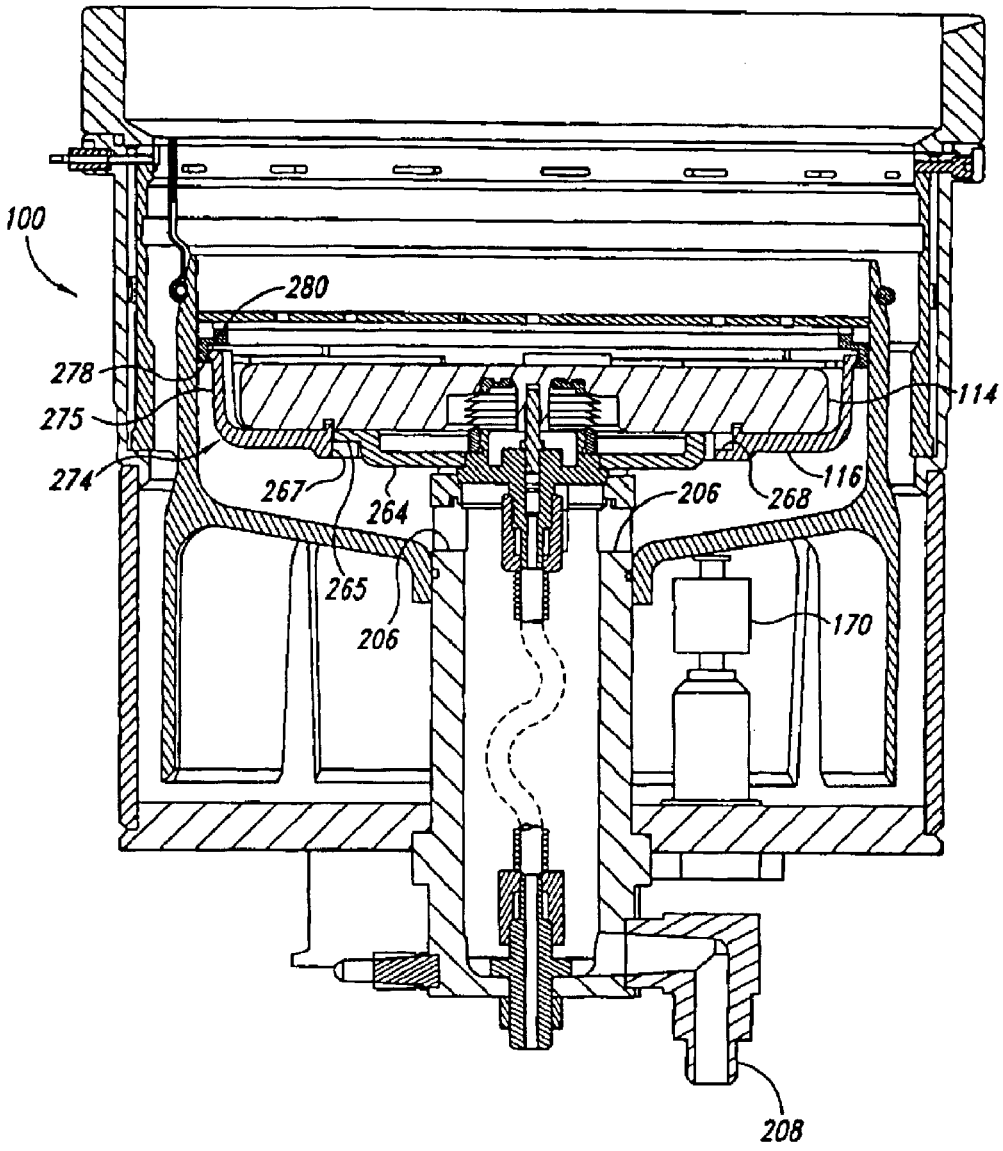
FIG. 9 is a sectional view taken generally along 9—9 of FIG. 5.

FIGS. 7–9 illustrate the rotor support ring 110 nesting into the exhaust ring 124 of the reservoir container assembly 120. The cup assembly 118 includes a cup inner sidewall 130 defining at its upper edge 130*a* an overflow weir, and a cup outer sidewall 131 which extends upward to a bottom 110*a* of the rotor support ring 110. The inner and outer sidewalls 130, 131 are radially connected by intermittent webs 132 formed integrally with the sidewalls 130, 131. A container or "cup" 139 for holding process fluid is formed by a cup bottom wall 138 and the inner sidewall 130.

The reservoir container assembly 120 includes a surrounding reservoir sidewall 140 that is sealed to a base plate 142 and supports the exhaust ring 124 at a top thereof. The cup assembly 118 is supported by an outer edge 131*b* of the outer sidewall 131 resting on a ledge 124*a* of the exhaust ring 124 which, in turn, is supported by a top edge 140*a* of the vessel sidewall 140. Thus the elevation and level of the cup assembly 118 is preferably fixed, i.e., it is non-adjustable With respect to the reservoir 120.

Figure 10:
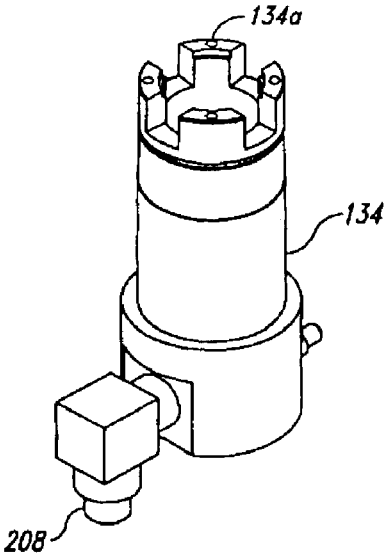
FIG. 10 is an enlarged perspective view of a fluid delivery tube shown in FIG. 7.

The anode 114 is connected by fasteners (as shown for example in FIG. 1) to the anode shield 116. The anode 114 is supported within the cup sidewall 130 by an anode support structure such as a fluid delivery tube or "anode post" 134. The anode post 134 is in the form of a cylindrical tube (see FIG. 10) having top and bottom ends substantially closed as described below. The anode post 134 extends through an opening 143 through the reservoir base plate 142 and through an opening 136 in the cup bottom wall 138. The anode post 134 is sealed to the cup bottom wall 138 around the opening 136 with an O-ring 137. Further, the anode post is sealed to the base plate 142 around the opening 143 by plastic welding or other sealing technique.

Extending downwardly from the cup sidewall 130 is a fluted skirt 148 having a plurality of slots 150 for allowing passage of process fluids. Through the base plate 142 of the reservoir container 120 passes an overflow standpipe 154 having an open end 155 for receiving process fluid. Also, connected to the bottom wall 142 is a process outlet 158 for the draining of process fluid from the reservoir container 120. It is to be understood that the standpipe 154 and the process outlet 158 would be connected to process piping to deliver process fluid to a recycling system or other process fluid system. In this regard, a precise control of the process fluid level in the container 120 can be maintained through use of a high process fluid level switch 170 and a low process fluid level switch 171 within the container 120 which open and close a control valve (not shows) connected to the outlet 158.

The anode electrical conductor assembly 122 includes at a bottom end thereof, a fitting 190 having a bottom region 191 threaded for receiving a nut 192. The fitting 190 can be firmly tightened to a bottom wall 200 of the anode post 134. The fitting 190 includes a top flange 190*a* with an O-ring seal element 190*b* which is drawn into sealing engagement with the top surface 200*a* of the wall 200 by advancement of the nut 192 on the fitting 190.

The anode post 134 includes an internal volume 204 in fluid communication With outlet openings 206 (shown in FIG. 8), and with a bottom supply nozzle 208 (shown in FIG. 8), for delivering process fluid into the cup 139, from an outside source of process fluid. The anode post 134 is closed at a top end by a top cap 194.

The anode electrical conductor assembly 122 includes a corrugated sleeve 210 sealed by a first coupling 212 to a neck 213 of the fitting 190. The sleeve surrounds a conductor wire 221 shown schematically as a line. The wire 221 is not shown in FIGS. 8 and 9 for clarity. The corrugated sleeve 210 extends upwardly and is sealed to a neck 225 of a fitting 195 of the top cap 194 by a second coupling 224.

FIG. 7A illustrates the sealing arrangement used at the couplings 212, 224. The necks 213, 225 receive a pre-flared, non-corrugated end 210*b* (or 210*c*) of the corrugated sleeve 210 which is then compressed by a tapered inside surface 225*a* of the respective coupling 212, 224, against a tapered outer surface 225*b* of the respective necks as the coupling threads 226 are advanced on respective fitting threads 227. This sealing arrangement is similar to commercially available flared fittings.

The top cap 194 includes a support ring 240. The support ring guides a conductor tip 220 held vertically within a central aperture of the support ring. The tip 220 is electrically connected to the conductor wire 221. The cap 194 further includes a surrounding guide ring 242 around which is carried a bellows seal 260 which extends upwardly from the cap 194. The bellows seal surrounds the tip 220 and, in its relaxed state, extends to a position upwardly thereof. The bellows seal 260 includes a top opening 262 in registry with the tip 220, and a surrounding groove 260*c* for holding an O-ring seal element 260*b* (see FIGS. 11–13).

Figure 11:
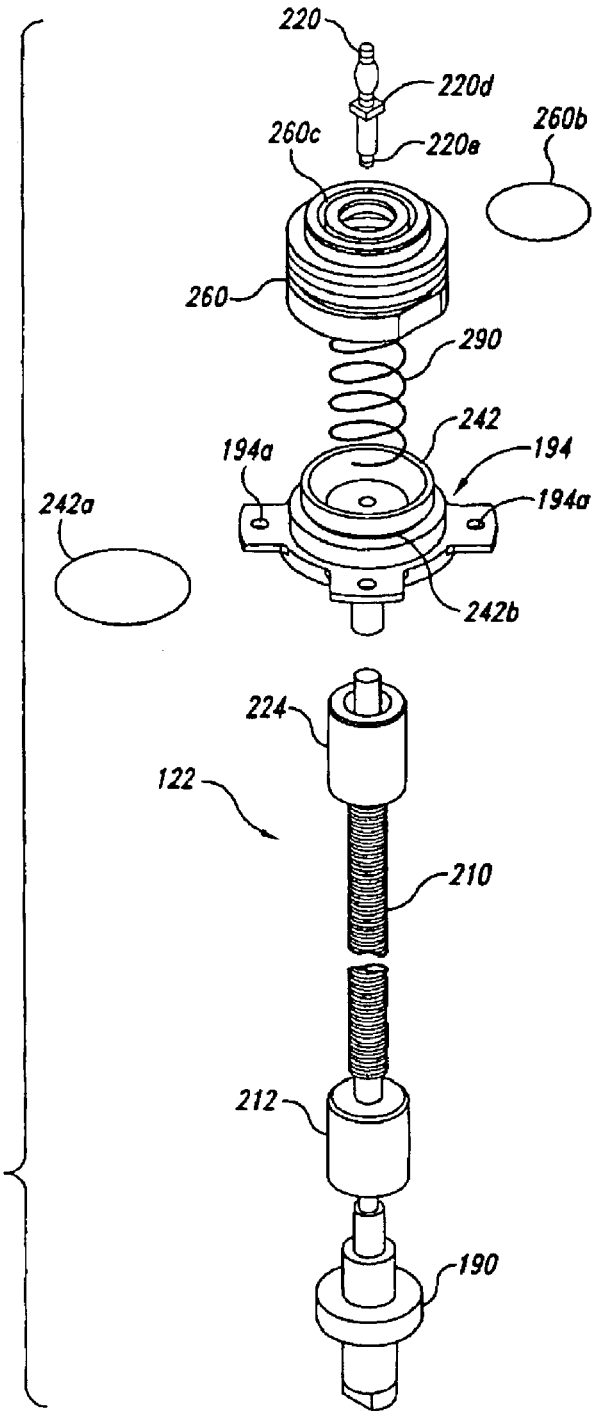
FIG. 11 is an exploded perspective view of one embodiment of an anode conductor assembly.

The top cap 194 is substantially cross-shaped in plan view, having a plurality of fastener holes 194*a* (see FIG. 11). A substantially circular, dished attachment plate 264 is arranged coaxially with the top cap 194 and includes a central aperture 266 for receiving the guide ring 242 of the top cap 194. The attachment plate 264, and the cap 194 are fastened together and to the post 134, via an interposed spacer 228, by four fasteners 229. The fasteners are fit into four holes 264*a* through the attachment plate 264 (show in FIG. 4), the four fastener holes 194*a* through the top cap 194, four holes 228*a* through the spacer (shown in FIG. 4), and then threaded into four threaded holes 134*a* of the anode post (shown in FIG. 10). The spacer 228 is selected for a precise thickness to set the elevation of the anode 114 with respect to the cup assembly 118, particularly with respect to the top edge 130*a* of the sidewall 130.

Figure 17:
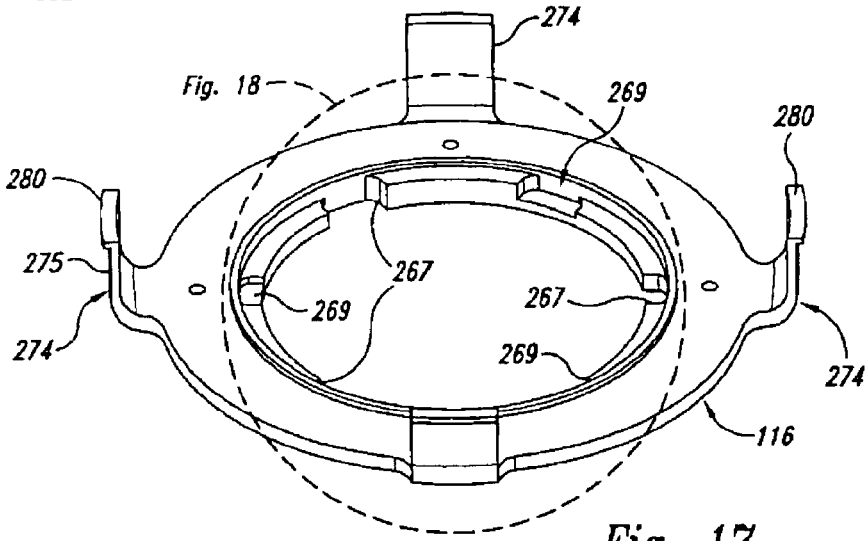
FIG. 17 is a perspective view of one embodiment of an anode shield as used in the reactor vessel of FIG. 3.
Figure 18:
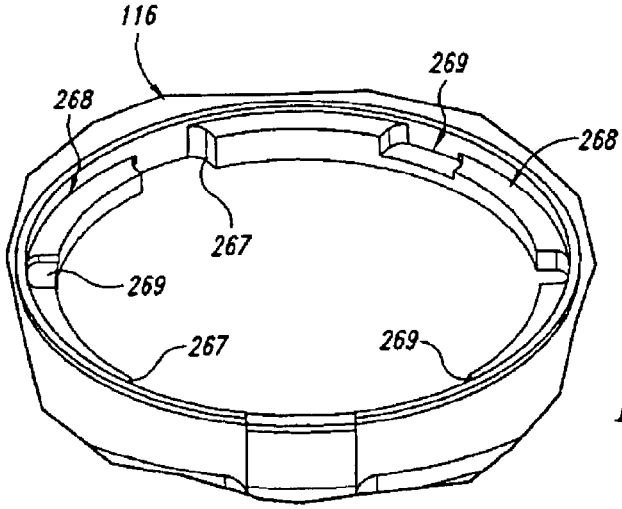
FIG. 18 is a fragmentary enlarged perspective view of the anode shield of FIG. 17.

The attachment plate 264 is connected to the anode assembly by a bayonet connection. A bayonet connection is characterized as one in which one part is connected to another part by first a movement toward each other and then a second relative rotational movement between the parts. The attachment plate 264 includes a plurality of spaced apart, radially extending tabs 265. During installation of the anode assembly, the tabs 265 vertically enter vertical slots 267 (see FIGS. 9, 17 and 18) formed in the anode shield 116, and upon turning of the anode assembly 117 from above, the tabs 265 are advanced relatively in circular, substantially horizontal slots 268 formed between the anode 114 and the shield 116. The horizontal slots 268 each terminate in a tab-receiving recess 269 which restrains the tabs from rotational disengagement once completely installed. Spring force from a bellows spring (described below) holds the tabs 265 within the recesses 269. During engagement of the tabs 265, the bellows 260 and bellows spring are vertically compressed as the tip 220 is plugged into a socket 270 formed in the anode 114 to make a solid "plug-in" or "plug-and-socket" electrical connection thereto.

To disengage the anode assembly from the attachment plate 264, the anode is pressed downwardly to elevate and disengage the tabs 265 from the recesses 269, and the anode is turned or rotated to align the tabs with the vertical slots 267. The anode assembly can then be withdrawn upwardly. The tip 220 still be pulled free from the socket 270 and resiliently open up once free of the socket.

Figure 4:
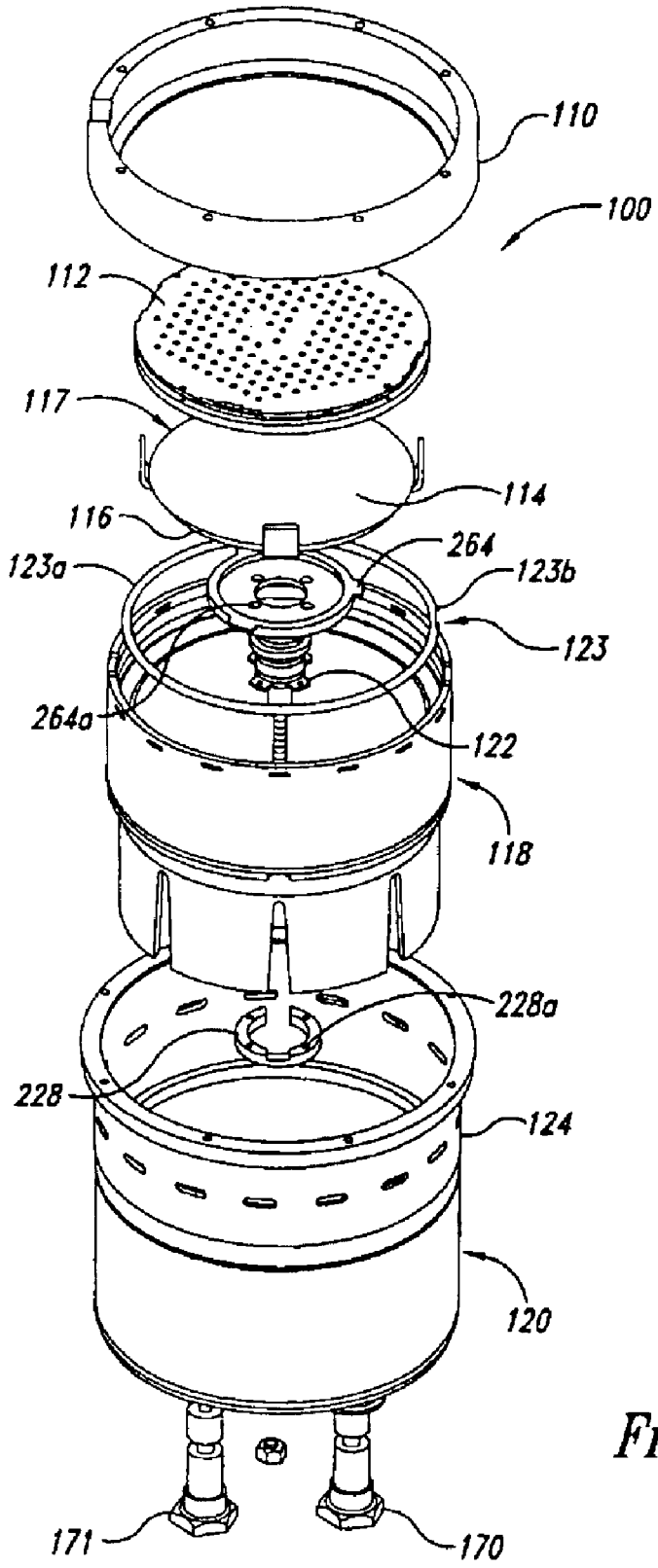
FIG. 4 is an exploded perspective view of the reactor vessel of FIG. 3.

It can be observed that the height adjustment of the anode can be set entirely from above. First, the anode 114 and shield 116 are removed from the attachment plate 264. Second, the attachment plate is removed from the post 134 by removal of the fasteners 229. Third, the cap 194 is lifted upwardly, and the spacer 228 is replaced with a spacer having a desired thickness dimension. As shown in FIG. 4 the spacer 228 is C-shaped to facilitate replacement around the conductor assembly 122 without complete disassembly thereof, i.e., there is no need to remove the tip 220 or the top cap 194 from the conductor wire.

Figure 21:
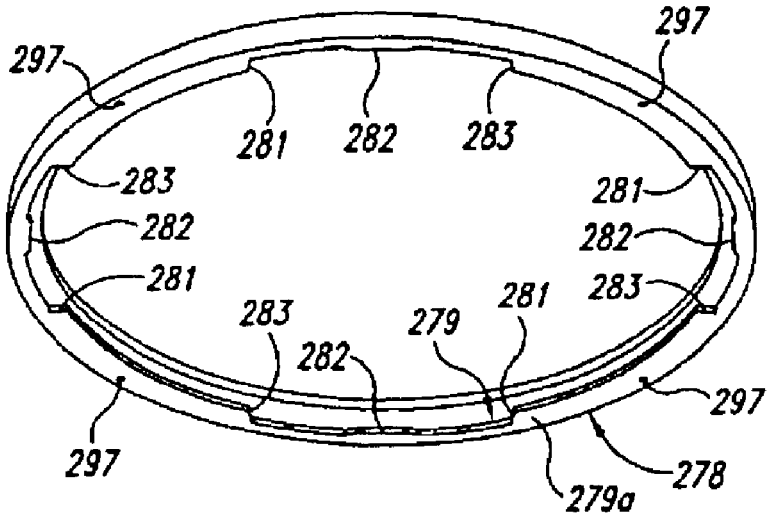
FIG. 21 is a bottom perspective view of one embodiment of a bottom ring portion of the diffusion plate of FIG. 19.

As illustrated particularly in FIGS. 8 and 9, the diffusion plate 112 is connected to intermittently arranged upstanding bracket members 274 using bayonet connections. As shown in FIGS. 9 and 21, a connector ring 278 of the diffusion plate 112 has a C-shaped cross-section forming a channel 279. Each bracket 274 includes a vertical leg 275 and a radially, outwardly extending tab member 280. During installation, each tab member 280 enters a wide slot or recess 281 through the bottom leg 279*a* of the C-shaped cross-section. Upon relative turning between the ring 278 and the bracket 274, each vertical leg 275 of each bracket 274 resiliently passes a detent 282 and enters a more narrow slot or recess 283. Each detent 282 thus resiliently locks a bracket member 274 to the connector ring 278. To remove the diffusion plate 112 from the anode assembly 117, the plate is rotated in an opposite direction. The legs 275 resiliently deflect radially inwardly a sufficient amount to pass the detents 282. Finally, the tab members 280 are withdrawn through the recesses 281.

Figure 12:
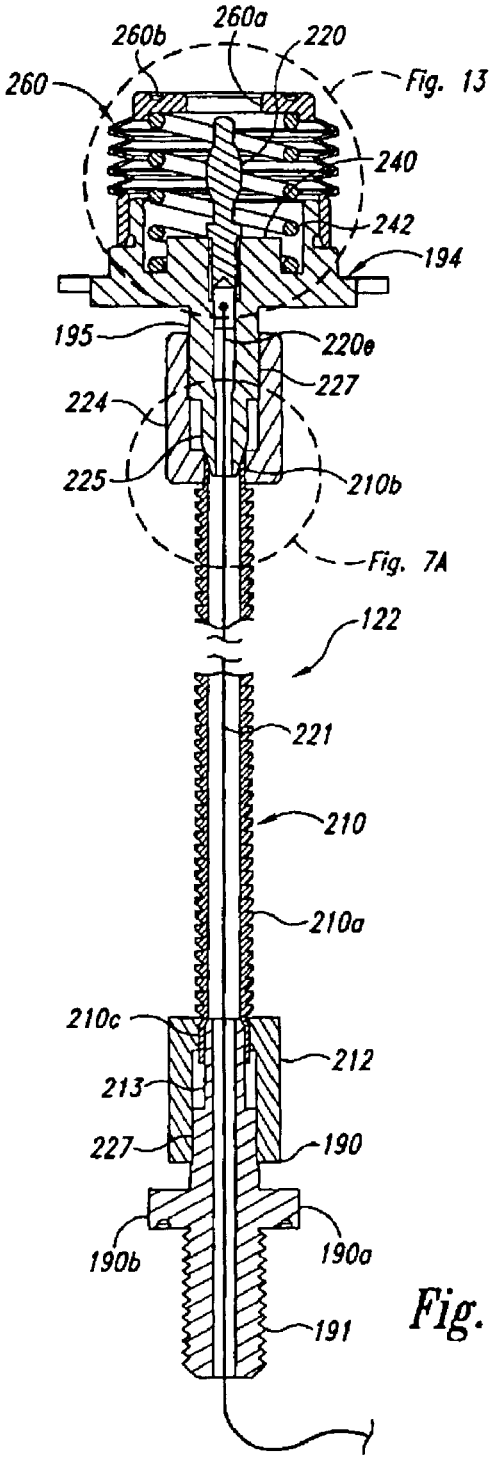
FIG. 12 is a sectional view of the anode conductor assembly of FIG. 11.
Figure 13:
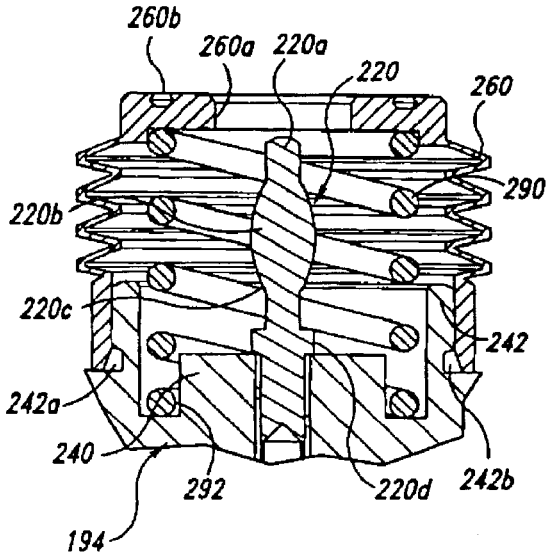
FIG. 13 is an enlarged fragmentary sectional view of the anode conductor assembly of FIG. 12.

FIGS. 11–13 illustrate the construction of one embodiment of the anode conductor assembly in more detail. As illustrated, the anode tip 220 has a profile which compresses when installed in the socket 270 of the anode. The tip includes a small diameter distal end region 220*a,* a wide central region 220*b,* and a narrow base region 220*c.* The base region 220*c* terminates at a flange or stop 220*d* which sets the extension of the tip 220 from the support ring 240 of the cap 194.

The tip 220 includes a soldering connection or crimping region 220*e* at a bottom end thereof that is used for connecting it to the conductor wire 221 (shown schematically in FIG. 12). The conductor wire 221 extends downwardly from the tip 220 through the fitting 195 of the cap 194, the corrugated sleeve 210, and the bottom fitting 190. From the bottom fitting 190, the fire 221 extends externally of the reactor vessel 100 for connection to a plating power supply.

The corrugated sleeve 210 includes a corrugated length 210*a* between the couplings 212, 224 and a first non-corrugated portion 210*b* which over-fits the neck 225 of the fitting 195, and a second non-corrugated portion 210*c* which over-fits the neck 213 of the fitting 190 as illustrated in FIG. 7A. The couplings 212, 224, by progressive threaded tightening onto the respective necks 213, 225, seal the non-corrugated regions 210*b,* 210*c* onto the fittings 190, 195 to form a sealed configuration around the conductor wire within the anode post 134.

FIG. 11 illustrates the assembly of the conductor assembly 122, absent the wire conductor for clarity. The O-ring 260*b* is arranged to fit within a channel 260*c* of the bellows 260. Another O-ring 242*a* is arranged to fit within a channel 242*b* (see FIG. 13) of the guide ring 242 to seal the bellows 260 to the top cap 194.

As illustrated in FIG. 13, a bellows coil spring 290 is fit within the bellows 260 and the top cap 194. The spring 290 is fit within an annular channel 292 formed between the guide ring 242 and the support ring 240. The spring 290 urges the anode assembly away from the attachment plate 264 to resiliently seat the tabs 265 in the tab-receiving recesses 269. Additionally, the spring acts to press the O-ring 260*b* into the anode to effect a tight seal thereto.

Figure 14:
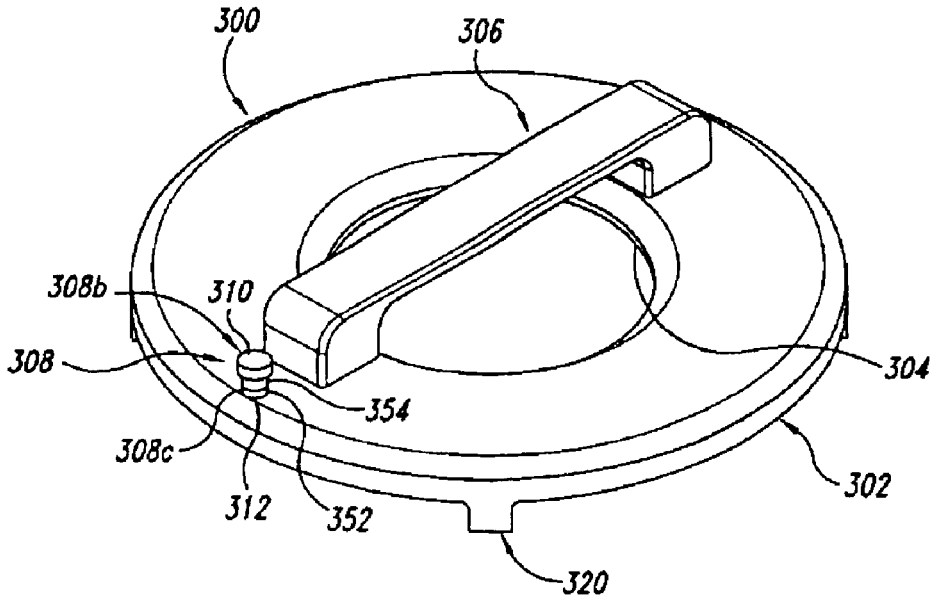
FIG. 14 is a top perspective view of a diffusion plate and anode removal/installation tool constructed in accordance with one embodiment of the present invention.

FIG. 14 illustrates a multi-function diffusion plate and anode removal/installation tool 300 of the present invention. The tool 300 includes a disc structure 302 having a central hole 304. Bridging across the central hole is a handle 306. The handle is held to the disc structure by fasteners 307 (shown in FIG. 15). A lock pin 308 having a grip head 310 penetrates a pin receiving hole 312 through the disc structure 302.

Figure 5:
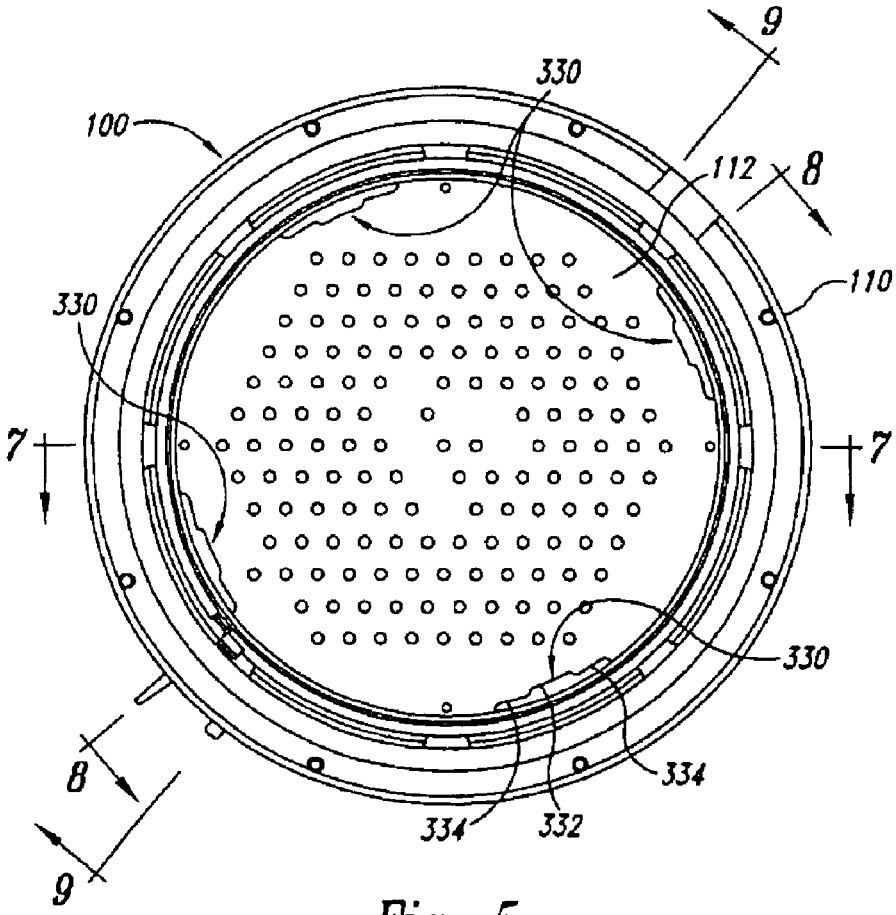
FIG. 5 is a top view of the reactor vessel of FIG. 3.
Figure 6:
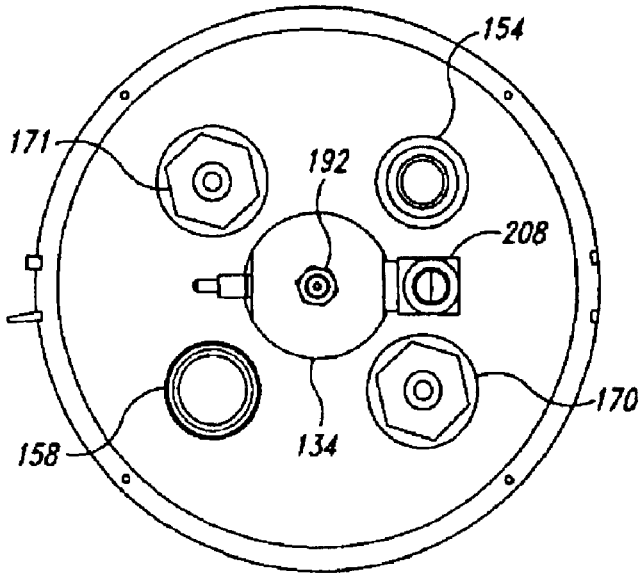
FIG. 6 is a bottom view of the reactor vessel of FIG. 3.
Figure 15:
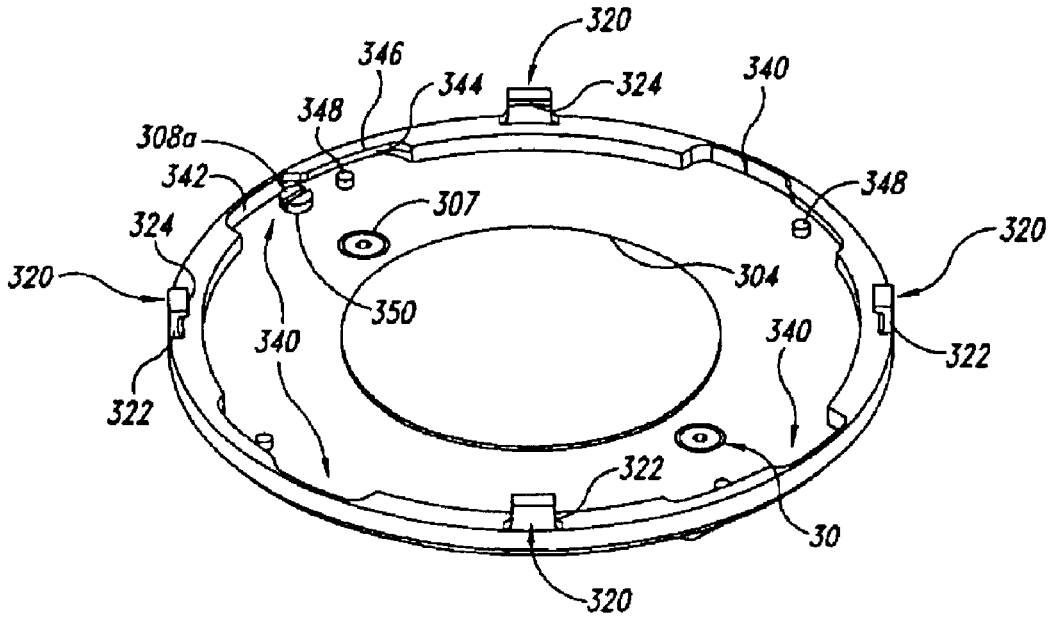
FIG. 15 is a bottom perspective view of the tool of FIG. 14.
Figure 19:
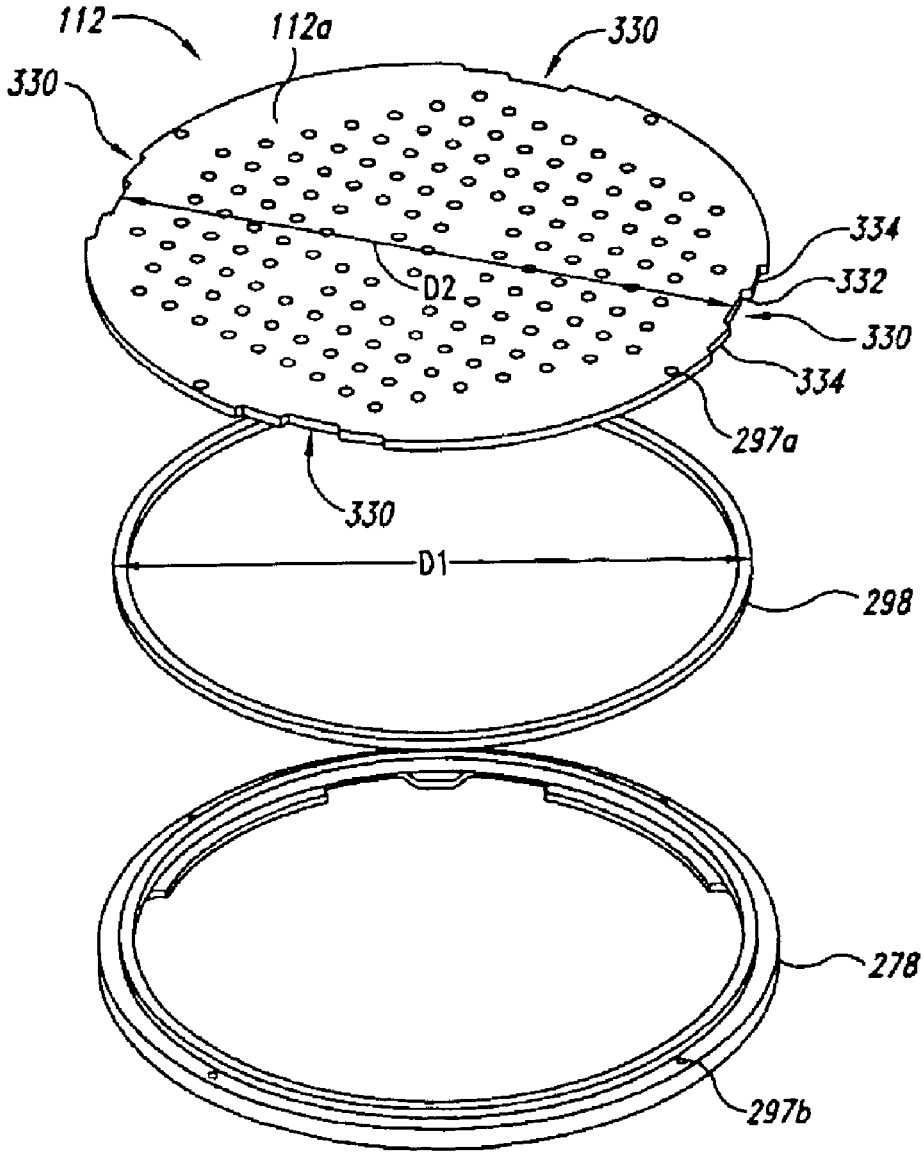
FIG. 19 is an exploded perspective view of one embodiment of a diffusion plate as used in the reactor vessel of FIG. 3.
Figure 20:
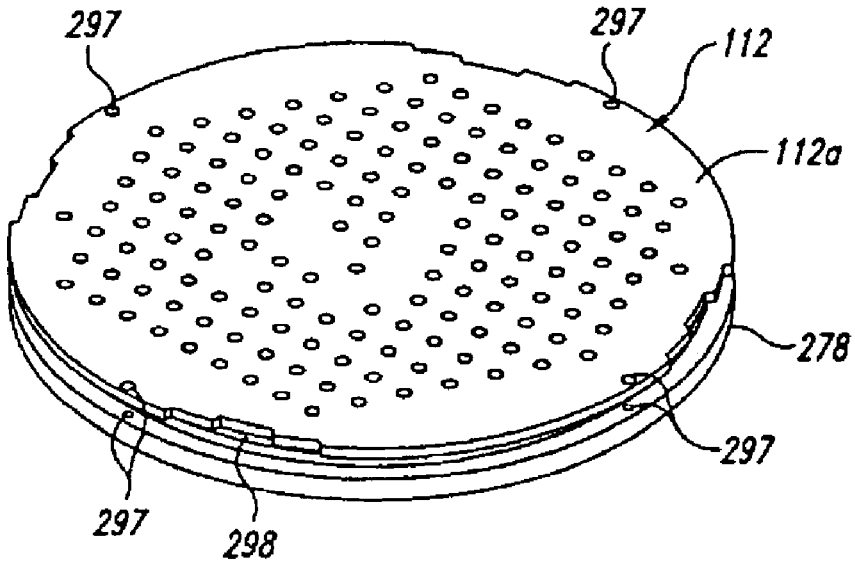
FIG. 20 is a perspective view of the diffusion plate of FIG. 19.

As illustrated in FIG. 15, the disc structure includes four L-shaped hook arms 320, each having a vertical leg 322 and a radially inwardly directed detent or hook portion 324. In operation, the hook arms 320 extend downwardly. The hook arms 320 are configured and arranged to engage bayonet recesses 330 formed through an outside of a top perforated plate 112*a* of the diffusion plate 112 as illustrated in FIGS. 5, 19 and 20. Each recess 330 includes a wide region 332 for receiving a hook portion 324, and two narrow regions 334 for snugly receiving a leg 322 into a locked position (in either direction depending on whether removal or installation is taking place). When the leg 322 moves in this position, the hook portion 324 is located below the top perforated plate 112*a.* The tool with engaged diffusion plate can then be rotated in one direction to remove the diffusion plate 112, or rotate in an opposite direction to install the diffusion plate 112 from or onto the brackets 274.

The tool 300 also serves as an anode assembly removal/installation tool once the diffusion plate 112 has been removed. On a bottom surface of the tool 300 are located four bracket/engaging recesses 340 that are spaced apart to mate with the brackets 274 of the anode shield 116. Each recess 340 includes a recess region 342 for receiving the radially turned end of the bracket 274 therethrough. A further recess region 344 is defined at least in part, by a radially extending ledge 346. Extending vertically from the disc structure 302 are four guide pins 348. Each guide pin 348 is radially spaced from a respective ledge 346 by a distance approximately equal to, or greater than, a radial thickness of a respective bracket vertical leg 275. Thus, in operation, the tool 300 is placed onto the anode assembly 117 with each bracket 274 received into one of the wide recess regions 342. The tab member 280 of each bracket 274 is located above a respective ledge 346. The tool is then rotated relative to the anode such that the vertical leg 275 of each bracket 274 slides circumferentially between a respective ledge 346 and a respective guide pin 348. The tab member 280 of each bracket 274 is thus captured above the respective ledge 346.

The lock pin 308 is operated by force of gravity to fall to a position behind one of the brackets 274 which has passed into the narrow recess region 344. The lock pin 308 thus prevents inadvertent reverse rotation of the tool relative to the anode. This prevents accidental separation of the tool and the relatively heavy anode assembly during removal, assembly or transporting of the anode assembly. The lock pin 308 is preferably formed of two pieces: a bottom piece 308*a,* having a tool engageable head 350 connected to a first barrel 352, and a top piece 308*b* which includes the gripping head 310 connected to a second barrel 354. The first barrel has a male threaded extension (not shown) which is engaged by a female threaded socket (not shows) of the second barrel. Thus relative rotation of the first and second barrels can separate or join the two pieces 308*a,* 308*b* at a seam 308*c* for disassembly or assembly of the pin 308. The gripping head 310 and the engageable head 350 allow retention of the pin to the interposed disc structure 302, while still allowing vertical reciprocation with respect thereto.

Figure 16:
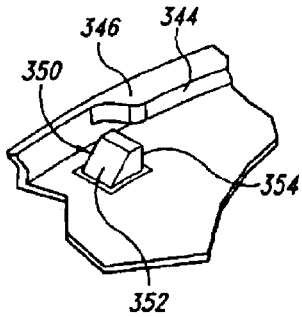
FIG. 16 is a fragmentary bottom perspective view of an alternate lock pin arrangement for the tool in FIG. 14.

Additionally, as illustrated in FIG. 16, the lock pin can alternately be configured to allow lifting of the lock pin by sliding pressure (rather than manual lifting) of the respective bracket 274 during engagement of the tool to the anode assembly. The pin is designed to be lifted by the top surface of the tab 274 as it enters the slot 342 and then falls into position upon rotation of the handle. The lock pin however can require manual lifting of the pin to disengage the tool from the anode assembly, by relative rotation therebetween. This is accomplished, for example, by a ratchet tooth shaped pin 350, wherein the ratchet tooth shaped pin would provide a slanted surface 352 facing an engagement direction with the bracket 274. The pin 350 includes a vertical surface 354 facing a tool disengagement direction. A retaining mechanism such as a detent (not shown) or a two piece construction with enlarged heads (such as described with regard to the pin 308) can be provided on the shaped pin to prevent separating of the shaped pin from the interposed disc structure 302. The retaining mechanism would allow vertical reciprocation of the pin with respect to the disc structure.

The tool 300 thus provides an effective means to disassemble and reassemble the diffusion plate and anode assembly from the vessel. The tool also reduces contact, damage and contamination of the anode and anode film.

FIGS. 19–20 illustrate the diffusion plate 112 in detail. The diffusion plate includes the top perforated plate 112*a* which is attached by fasteners (not shown) through four fastener hole pairs 297*a,* 297*b* to the connector ring 278, capturing a spacer ring 298 therebetween. The holes 297*b* are threaded to engage the fasteners. The spacer ring 298 has a smaller outside diameter D1 than an inside diameter D2 between diametrically opposing wide recesses 332 to ensure noninterference of the spacer ring 298 with the hook arms 320 of the tool 300 during installation or removal of the diffusion plate. The thickness of the spacer ring 298 provides a vertical space below the perforated plate 112*a,* particularly below the bayonet recesses 330, for the hook portion 324 to be received.

In the disclosed embodiment, the cup assembly 118, the anode post 134, the reservoir container 120, the anode shield 116, the diffusion plate 112, the exhaust ring 124, the rotor support ring 110, the corrugated sleeve 210, the spacer 228, the fasteners 229, the top cap 194, the fitting 190, the nut 192, the couplings 212, 224, and the attachment plate 264, are all preferably composed of dielectric materials such as natural polypropylene or polyvinylidene fluoride. The conductor wire 221 is preferably composed of copper or another appropriate conductor, as is the tip which also can be gold plated for enhanced electrical contact. The bellows seal 260 is preferably composed of a Teflon material. The bellows spring is preferably composed of stainless steel. The various O-rings are preferably composed of an acid compatible fluoro-elastomer, depending on the process fluid.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. An apparatus for processing microelectronic workpieces, comprising:

a vessel having an inner portion and an outer portion disposed outwardly from the inner portion, the inner portion being coupleable to a source of processing liquid, the vessel having a flow path along which the processing liquid flows from the inner portion to the outer portion;

a wall between the inner portion and the outer portion, the wall being positioned to receive processing liquid proceeding upwardly through the inner portion to the outer portion;

an electrode support positioned within the inner portion of the vessel and configured to carry an electrode; and a flow control structure positioned along the flow path downstream of the electrode support, the flow control structure including a liquid pervious portion and a liquid impervious portion disposed annularly outwardly from the liquid pervious portion.

2. The apparatus of claim 1 wherein the electrode includes a first electrode and wherein the apparatus further comprises a processing head positioned proximate to the vessel, the processing head being configured to carry a microelectronic workpiece at the processing site, the processing head having a second electrode configured to releasably contact the microelectronic workpiece.

3. The apparatus of claim 1 wherein the flow control structure includes at least one of a diffuser plate and a connector ring supporting the diffuser plate.

4. The apparatus of claim 1 wherein the flow control structure includes a diffuser plate having perforations at the liquid pervious portion and no perforations at the liquid impervious portion.

5. The apparatus of claim 1 wherein the inner portion of the vessel has an entrance port positioned beneath the electrode support and coupleable to a source of processing liquid.

6. The apparatus of claim 1 wherein the flow control structure includes a diffuser plate and wherein the electrode support includes brackets configured to removably support the diffuser plate.

7. The apparatus of claim 1 wherein the liquid pervious portion of the flow control structure is positioned to align with a central portion of a microelectronic workpiece during processing, and wherein the liquid impervious portion of the flow control structure is positioned to align with a peripheral portion of the microelectronic workpiece disposed outwardly from the central portion of the microelectronic workpiece.

8. The apparatus of claim 1, further comprising the electrode.

9. An apparatus for processing microelectronic workpieces, comprising:

a vessel having an inner portion and an outer portion disposed outwardly from the inner portion, the inner portion being coupleable to a source of processing liquid;

a wall between the inner portion and the outer portion, the wall being positioned to receive processing liquid proceeding upwardly through the inner portion to the outer portion, the wall having an edge positioned at least proximate to a workpiece processing site;

an electrode support positioned within the inner portion of the vessel, the electrode support being configured to support an electrode in liquid communication with the processing site; and a flow control structure positioned between the electrode support and the processing site, the flow control structure including a liquid pervious portion aligned with a first portion of the processing site, the flow control structure further including a liquid impervious portion, disposed annularly outwardly from the liquid pervious portion and aligned with a second portion of the processing site.

10. The apparatus of claim 9 wherein the electrode is a first electrode and wherein the apparatus further comprises a processing head positioned proximate to the vessel, the processing head being configured to carry a microelectronic workpiece at the processing site, the processing head having a second electrode configured to releasably contact the microelectronic workpiece.

11. The apparatus of claim 9 wherein the flow control structure includes at least one of a diffuser plate and a connector ring supporting the diffuser plate.

12. The apparatus of claim 9 wherein the flow control structure includes a diffuser plate having perforations at the liquid pervious portion and no perforations at the liquid impervious portion.

13. The apparatus of claim 9 wherein the inner portion of the vessel has an entrance port coupleable to a source of processing liquid and positioned beneath the electrode support.

14. The apparatus of claim 9 wherein the flow control structure includes a diffuser plate and wherein the electrode support includes brackets configured to removably support the diffuser plate.

15. The apparatus of claim 9 wherein the liquid pervious portion of the flow control structure is positioned to align with a central portion of a microelectronic workpiece when the microelectronic workpiece is carried at the processing site, and wherein the liquid impervious portion of the flow control structure is positioned to align with a peripheral portion of the microelectronic workpiece disposed outwardly from the central portion of the microelectronic workpiece.

16. The apparatus of claim 9 wherein the wall between the inner portion and the outer portion of the vessel has an inward facing surface and an outward facing surface, and wherein the liquid impervious portion of the flow control structure is positioned at least proximate to the inward facing surface of the wall.

17. The apparatus of claim 9, further comprising the electrode.

18. An apparatus for processing microelectronic workpieces, comprising:

a vessel having an inner portion and an outer portion disposed outwardly from the inner portion, the vessel having a flow path along which the processing liquid flows from the inner portion to the outer portion;

a wall between the inner portion and the outer portion, the wall being positioned to receive processing liquid proceeding upwardly through the inner portion to the outer portion;

a head configured to carry a microelectronic workpiece;

an electrode support positioned within the inner portion of the vessel and configured to carry an electrode;

a flow control structure positioned along the flow path downstream of the electrode support, the flow control structure including a liquid pervious portion and a liquid impervious portion disposed annularly outwardly from the liquid pervious portion; and a source of processing liquid coupled in liquid communication with the inner portion of the vessel.

19. The apparatus of claim 18, further comprising the electrode.

20. A method for processing a microelectronic workpiece, comprising:

carrying a microelectronic workpiece in contact with a processing liquid, the processing liquid being disposed in a vessel having an inner portion and an outer portion disposed outwardly from the inner portion;

flowing the processing liquid adjacent to an electrode in the inner portion of the vessel and through a liquid pervious portion of a flow control device positioned downstream of the electrode;

at least restricting the flow of processing liquid through a liquid impervious portion of the flow control device that is positioned annularly outwardly from the liquid pervious portion; and flowing the processing liquid upwardly through the inner portion of the vessel, over a wall to the outer portion of the vessel, and adjacent to a surface of the microelectronic workpiece.

21. The method of claim 20 wherein the electrode is a first electrode and wherein the method further comprises:

positioning a second electrode in contact with the surface of the microelectronic workpiece; and electrolytically applying a conductive material from the processing liquid to the surface of the microelectronic workpiece.

22. The method of claim 20 wherein flowing the processing liquid through a liquid pervious portion of a flow control device includes flowing the processing liquid through perforations of a diffuser plate.

23. The method of claim 20 wherein at least restricting the flow of processing liquid through a liquid impervious portion of the flow control device includes preventing the flow of the processing liquid through at least one of a non-perforated portion of a diffuser plate and a connector ring supporting the diffuser plate.

24. The method of claim 20, further comprising:

aligning a first portion of the microelectronic workpiece to be in liquid communication with the liquid pervious portion of the flow control device; and aligning a second portion of the microelectronic workpiece to be in liquid communication with the liquid impervious portion of the flow control device, the second portion of the microelectronic workpiece being disposed annularly outwardly from the first portion.

* * * * *

UNITED STATES PATENT AND TRADEMARK OFFICE

CERTIFICATE OF CORRECTION

PATENT NO. : 6,890,415 B2
DATED : May 10, 2005
INVENTOR(S) : Daniel J. Woodruff et al.

It is certified that error appears in the above-identified patent and that said Letters Patent is hereby corrected as shown below:

Column 4,
Line 51, "Which" should be -- which --;

Column 9,
Line 21, "(not shows)" should be -- (not shown) --;
Line 32, "With" should be -- with --;

Column 10,
Line 6, "(show in FIG. 4)" should be -- (shown in FIG. 4) --;
Line 40, "still" should be -- will --;

Column 11,
Line 20, "the fire 221" should be -- the wire 221 --.

Signed and Sealed this

Fourth Day of October , 2005

JON W. DUDAS
*Director of the United States Patent and Trademark Office*